US010450170B2

(12) United States Patent
Koenig et al.

(10) Patent No.: US 10,450,170 B2
(45) Date of Patent: Oct. 22, 2019

(54) MOBILE CRANE HAVING ADJUSTABLE BALLAST MOUNTING APPARATUS

(71) Applicant: Liebherr-Werk Ehingen GmbH, Ehingen/Donau (DE)

(72) Inventors: Heinz Koenig, Biberach (DE); Franz Oelberger, Senden (DE); Hans-Dieter Willim, Ulm-Unterweiler (DE); Lars Eberhardt, Staig (DE); Jan Keppler, Neu-Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 258 days.

(21) Appl. No.: 15/651,921

(22) Filed: Jul. 17, 2017

(65) Prior Publication Data

US 2018/0022586 A1 Jan. 25, 2018

(30) Foreign Application Priority Data

Jul. 19, 2016 (DE) ..... 10 2016 008 822

(51) Int. Cl.
*B66C 23/76* (2006.01)
*B66C 23/84* (2006.01)
*B66C 23/36* (2006.01)

(52) U.S. Cl.
CPC ..... *B66C 23/76* (2013.01); *B66C 23/84* (2013.01); *B66C 23/36* (2013.01)

(58) Field of Classification Search
CPC ..... B66C 23/72; B66C 23/74; B66C 23/76; E02F 9/18; B62D 49/085
See application file for complete search history.

(56) References Cited

U.S. PATENT DOCUMENTS 2,985,317 A * 5/1961 Bannister ..... B66C 23/74 212/195
3,375,021 A * 3/1968 Grider ..... B66C 23/74 212/196
3,726,416 A * 4/1973 Pottorff ..... B66C 23/72 212/178
4,363,412 A * 12/1982 Patel ..... B66C 23/74 212/178
4,402,413 A * 9/1983 Sickler ..... E02F 9/18 212/178
5,141,195 A * 8/1992 Toda ..... B66C 23/74 212/178
5,199,583 A * 4/1993 Weider ..... B66C 23/74 212/178
5,524,777 A * 6/1996 Weber ..... B66C 23/74 212/178

(Continued)

FOREIGN PATENT DOCUMENTS

DE 10103518 A1 8/2001
DE 102005018522 A1 11/2006

(Continued)

*Primary Examiner* — Michael R Mansen
*Assistant Examiner* — Juan J Campos, Jr.
(74) *Attorney, Agent, or Firm* — McCoy Russell LLP

(57) ABSTRACT

The present disclosure relates to a mobile crane having an undercarriage and a superstructure rotatable about an axis of rotation with respect to the undercarriage and having a ballast mounting apparatus couplable to the superstructure. The present disclosure is furthermore directed to a corresponding ballast mounting apparatus.

7 Claims, 7 Drawing Sheets

(56) References Cited

U.S. PATENT DOCUMENTS

| | | | | |
|---|---|---|---|---|
| 5,598,935 | A * | 2/1997 | Harrison | B62D 49/085 180/69.1 |
| 5,615,784 | A * | 4/1997 | Pech | B66C 23/74 104/306 |
| 6,481,202 | B1 * | 11/2002 | Zuehlke | B66C 23/36 212/299 |
| 6,481,748 | B1 * | 11/2002 | Okuda | E02F 9/0833 280/755 |
| 7,467,722 | B2 * | 12/2008 | Ramun | B66C 23/72 212/178 |
| 2005/0000121 | A1 * | 1/2005 | Mori | E02F 9/163 37/347 |
| 2014/0083781 | A1 * | 3/2014 | Kimura | E02F 9/00 180/6.7 |
| 2016/0185576 | A1 | 6/2016 | Bitz et al. | |

FOREIGN PATENT DOCUMENTS

| | | | |
|---|---|---|---|
| DE | 202010002364 | U1 | 1/2011 |
| DE | 102015013488 | A1 | 5/2016 |

* cited by examiner

MOBILE CRANE HAVING ADJUSTABLE BALLAST MOUNTING APPARATUS

CROSS REFERENCE TO RELATED APPLICATIONS

This application claims priority to German Patent Application No. 10 2016 008 822.2, entitled,"Mobile Crane Having Adjustable Ballast Mounting Apparatus," filed Jul. 19, 2016, the entire contents of which is hereby incorporated by reference in its entirety for all purposes.

TECHNICAL FIELD

The present disclosure relates to a mobile crane having an undercarriage and a superstructure rotatable about an axis of rotation with respect to the undercarriage and having a ballast mounting apparatus couplable to the superstructure.

BACKGROUND AND SUMMARY

Mobile cranes require a working space on a building site that is sufficiently large to ensure a complete and safe mode of operation of the mobile crane. There is, however, often only limited space or room available due to projecting edges at the construction site which can be produced by walls, planting, further work equipment or other obstacles.

The required working space is essentially determined by two factors. Whereas the first factor is the support base of the mobile crane which is defined by the respective support apparatus depending on the equipping state, the superstructure radius of rotation as the second major factor, that is the most extreme edge of the superstructure on the rotation of the superstructure about the undercarriage, also determines the working space of the mobile crane. As a rule this superstructure radius of rotation is influenced by the mounted ballast plates or by the apparatus for mounting the ballast plates since an installed ballast mounting apparatus, including the ballast plates, frequently projects the furthest out of the superstructure.

If the superstructure radius of rotation is reduced, the required working space for the mobile crane admittedly reduces on the one side. However, on the other side, the distance from the center of gravity of the ballast to the axis of rotation of the superstructure about the undercarriage is reduced. This in turn, however, reduces the torque which acts against the load torque generated by the load.

Mobile cranes are known from the prior art that have a first and a second ballast mounting apparatus that differ with respect to their physical dimensions and that are optionally releasably connected or connectable to the superstructure of the mobile crane. The ballast mounting apparatus used defines the superstructure radius of rotation which is described by the outermost component or outermost edge of the ballast mounting apparatus in the radial direction on a rotary movement of the superstructure. The support base and the superstructure radius of rotation can be matched to one another by the selective installation of the first or second ballast mounting apparatus to the mobile crane. This solution admittedly optimizes the superstructure radius of rotation, but has the result that two separate ballast mounting apparatus have to be provided or have to be kept available by the operator of the mobile crane.

Mobile cranes are further known from the prior art in which the spacing of a ballast mounting apparatus from the axis of rotation of the superstructure of the mobile crane can be changed by ballasting cylinders. Whereby the superstructure radius of rotation is correspondingly varied. The use of ballasting cylinders admittedly makes it possible to react flexibly to different loads on the mobile crane, but disadvantageously makes the setup of the total apparatus more complicated.

Disclosed herein is a mobile crane of the category whose construction minimizes the required working space on the construction site with as few additional components as possible and without any substantial increase in the complexity of the mobile crane.

In accordance with claim 1, at least one connection element in the mobile crane is provided at the superstructure of the mobile crane and at least two mating connection elements are provided at the ballast mounting apparatus, with the ballast mounting apparatus being couplable to the superstructure in positions of different spacing from the axis of rotation of the superstructure by the at least two mating connection elements. Advantageous embodiments of the mobile crane are the subject of the dependent claims.

The different coupling of the ballast mounting apparatus can in this respect in particular take place during the assembly of the mobile crane, in particular before its deployment, for which purpose the mobile crane itself does not have to have any additional actuators or other complex extensions.

It is conceivable in this respect in an embodiment that the ballast mounting apparatus comprises a ballast frame that is in particular formed as curved and/or as U-shaped in its horizontal plane.

The ballast frame can be configured in this respect such that the ballast held by it or the ballast plates held by it are couplable to the superstructure at different distances by the at least two mating connection elements. In this respect, the mating connection elements of the ballast mounting apparatus can be provided at different distances from the center of mass of the ballast mounting apparatus and of the mounted ballast plates and can thus introduce different torques into the superstructure on a corresponding coupling with the superstructure.

It is conceivable in a further embodiment that the mating connection elements are not simultaneously couplable to the connection elements. It is hereby ensured that in each case only one of the mating connection elements can be coupled to the superstructure and thus either a lower torque or a higher torque is necessarily introduced.

It is conceivable in a further embodiment that the ballast mounting apparatus is couplable to the superstructure in two positions rotated with respect to one another about a vertical axis, in particular by 180°. It is possible by the mutually rotated arrangement of the two positions to rotate the ballast mounting apparatus in a horizontal plane and thereby to introduce the different torques into the ballast wagon with little handling effort on a corresponding rotated coupling of the ballast mounting apparatus to the superstructure. The auxiliary units used for the typical assembly of the mobile crane can advantageously be used in this respect. A self-assembly is, however, also possible in the same manner.

Provision can in particular be made in this respect that the mating connection elements are provided at mutually oppositely disposed sides of the ballast mounting apparatus. The construction of the ballast mounting apparatus can hereby be simplified and it can be simply ensured that no different transverse torques are introduced into the superstructure in the two positions.

Provision can furthermore be made in an embodiment that the mating connection elements extend by different distances from the center of mass of the mounting apparatus.

On a corresponding coupling of the ballast mounting apparatus to the superstructure a different torque introduction into the superstructure resulting from the mass of the ballast mounting apparatus thereby results in dependence on the mating connection elements used.

It is conceivable in a further embodiment that at least one winch connection element for coupling a winch to the ballast mounting apparatus is provided at the ballast mounting apparatus, with the winch connection element in particular being configured as a part of the mating connection elements. The winch can in this respect also be couplable to different regions of the ballast mounting apparatus, with a winch connection element being able to be used in a different region of the ballast mounting apparatus depending on the position of the ballast mounting apparatus. It is hereby possible in a simple manner to be able to use a winch in different positions of the ballast mounting apparatus. It is conceivable in an embodiment in which the winch connection element is configured as a part of a mating connection element that mating connection elements currently not used for coupling the ballast mounting apparatus with the superstructure may be used for connecting the winch to the ballast mounting apparatus. The flexible winch connection can hereby be effected in a particularly simple manner and without additional components.

It is further conceivable in a further embodiment that at least one ballasting cylinder is provided at the ballast mounting apparatus to move the ballast mounting apparatus relative to the superstructure and/or to a base plate. It is, for example, possible by means of the ballasting cylinder to raise the ballast mounting apparatus from the undercarriage to the superstructure, after which the ballasting apparatus can be coupled to the superstructure. After a coupling of the ballast mounting apparatus to the superstructure, the ballasting cylinder can furthermore be moved in for the raising of the ballast plates or of the ballast provided at or to be attached to the ballast mounting apparatus. A base plate on which ballast plates can be arranged can be raised by the ballasting cylinder for this purpose. The ballasting cylinder can thus couple the base plate to the remaining structure of the ballast mounting apparatus movable linearly with respect to one another.

It is furthermore conceivable in an embodiment that at least one of the mating connection elements is configured as an intermediate frame releasably couplable to the ballast mounting apparatus. The intermediate frame can in this respect replace or supplement one of the mating connection elements in that it is installed between the first mating connection element and the connection element of the superstructure.

The present disclosure further relates to a ballast mounting apparatus for a mobile crane in accordance with one of the claims 1 to 7, wherein at least two mating connection elements that are arranged mutually offset and/or rotated are provided at the ballast mounting apparatus. It is possible in this respect, as described further above, to couple the ballast mounting apparatus to the superstructure of the mobile crane in two different positions by the at least two mating connection elements, with respective different torques being introduced into the superstructure in the two positions. The ballast mounting apparatus can furthermore have features that have been described further above with respect to the mobile crane and its ballast mounting apparatus.

Further advantages and details of the present disclosure are described with reference to the embodiment shown by way of example in the Figures and Detailed Description.

DETAILED DESCRIPTION

Figure 1A:
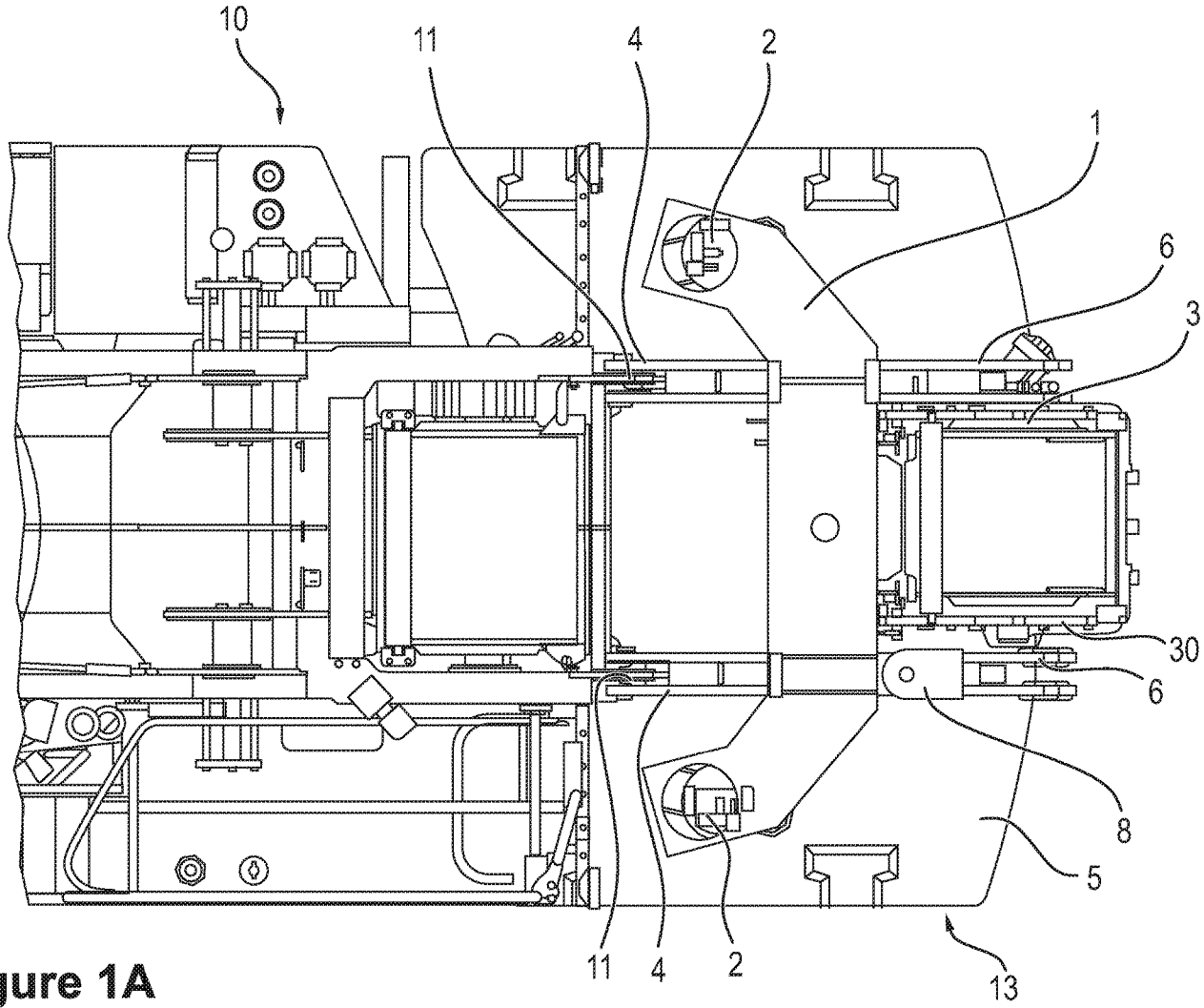
FIG. 1A shows a detailed view of a mobile crane in accordance with the present disclosure with a ballast mounting apparatus in a first position.
Figure 1B:
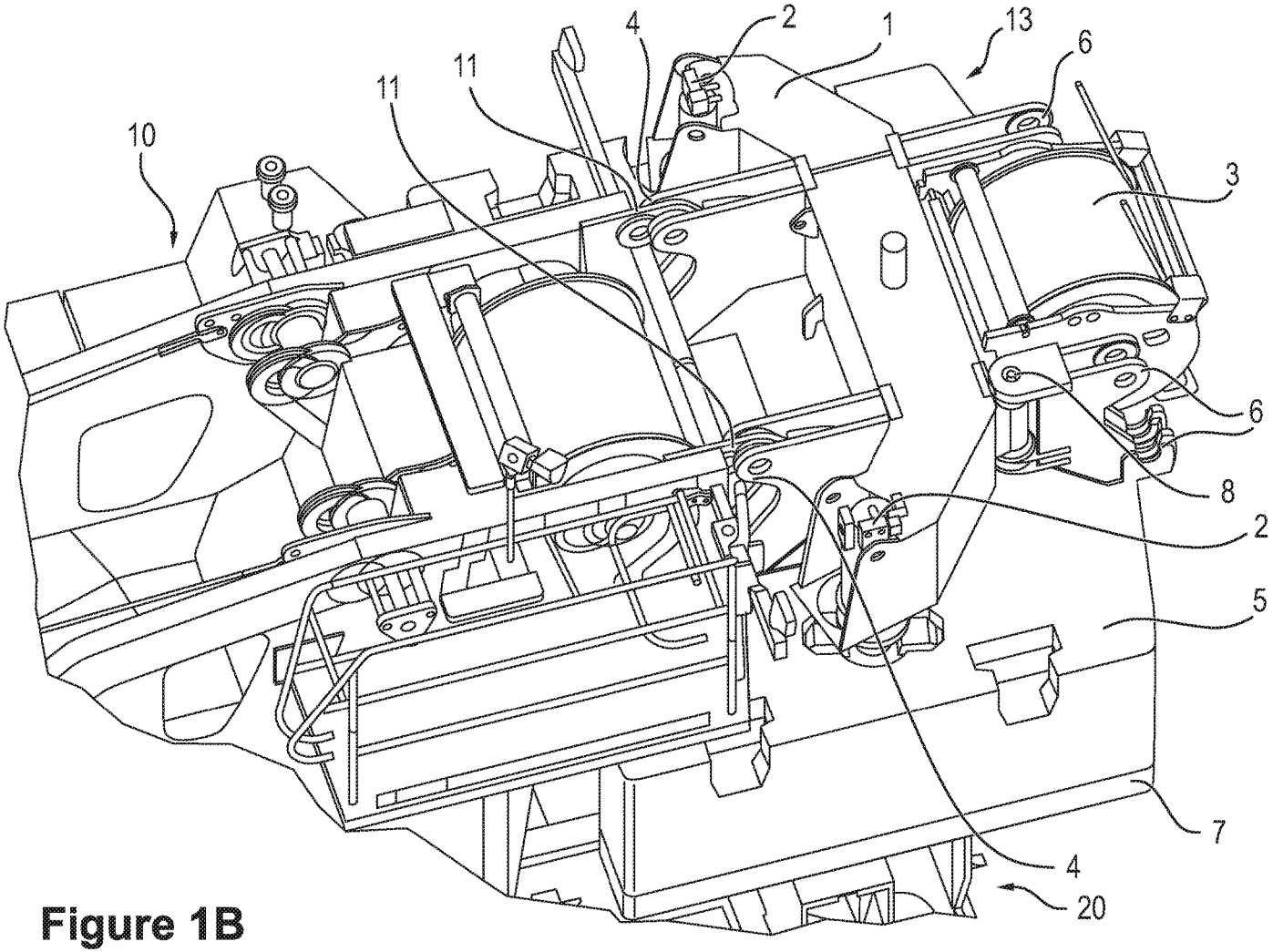
FIG. 1B shows a perspective view of a mobile crane in accordance with the present disclosure with a ballast mounting apparatus in the first position.

FIG. 1A shows a partial view of a mobile crane in accordance with the present disclosure, wherein the undercarriage 20 of the mobile crane is indicated at the bottom in FIG. 1B that shows a similar partial view. A superstructure 10 is provided on the undercarriage 20 and is rotatable with respect to it and the ballast mounting apparatus 100 couplable to the superstructure 10 is furthermore provided. The ballast mounting apparatus 100 is coupled to the superstructure 10 via a connection element 11 and a mating connection element 4, with the connection elements 11 being associated with the superstructure 10 and the mating connection elements being associated with the undercarriage 20. The connection elements 11 and the mating connection elements 4, 6 each comprise two connection geometries that are arranged laterally to one another at a ballast frame 11 of the ballast mounting apparatus 100.

In accordance with the present disclosure, a variable ballast radius can thus be provided that can be small in one setting to minimize the space requirements on the construction site and to improve the criterion "tilt to the rear" and that can be large in another setting to make a large load torque possible.

FIG. 1A shows the curved or angled ballast frame 1 that receives the ballasting cylinders 2. The ballast frame 1 can in this respect also or alternatively be of U shape. The first and second ballasting cylinders 2 can be arranged at the outer ends of the ballast frame 1 while the mating connection elements 4, 6 can be provided in a middle region of the ballasting frame 1 arranged between the ballasting cylinders 2. The ballast frame 1 can be formed from five mutually angled regions, with it in particular being symmetrical about a vertical plane extending in the longitudinal direction of the mobile crane.

The winch 3 is releasably attached to the curved ballast frame 1 via a winch connection element 30. The winch connection element 30 can in this respect be part of the mating connection elements 4, 6 or can be formed independently thereof. It is conceivable in this respect that the mating connection elements 4, 6 just not being used for coupling the ballast mounting apparatus 100 is used as a winch connection element 30. The winch 3 and the ballast frame together form the ballast 13 with the ballast base plate 7 and, optionally, further ballast plates 5. The superstructure 10 can furthermore be recognized. The superstructure 10 has the connection elements 11 for connection to the mating connection elements 4, 6 at the curved ballast frame 1. If the connection elements 11 are connected to the mating connection elements 4, 6, the taking up or the letting down of the ballast plates 5 can take place in a manner known per se. At the same time, the second mating connection elements 4 or 6 are then not coupled to the connection elements 11.

The mating connection elements 4, 6 can be configured as two bearing structures extending in parallel in the longitudinal direction of the mobile crane, with the front ends of the bearing structures each forming first mating connection elements 4 and the rear ends of the bearing structures forming second mating connection elements 6. An embodiment as four bearing structures correspondingly arranged at the ballast frame 1 is also conceivable, with two respective bearing structures offset from one another laterally forming first or second mating connection elements 4, 6 respectively. In this respect, first or second mating connection elements 4, 6 extend by different distances away from the total center of gravity of the ballast frame 1 or of the ballast 13 as well as of the ballast plates 5 in order thus to enable a different torque introduction with ballast via the first and second mating connection elements 4, 6.

The undercarriage 20 and the ballast base plate 7 are indicated in FIG. 1B. The ballast base plate 7 can be placed on the undercarriage 2 in two positions. It is thus positionable on the undercarriage 20 for the setting of the different ballast radii. In accordance with the present disclosure the curved ballast frame 1 now has additional, second mating connection elements 6. The mating connection elements 6 are equally suitable to be connected to the superstructure 10 by the connection elements 11. In this case, the curved ballast frame 1 would be attached to the superstructure 10 rotated by 180° and the spacing of the total center of gravity of the ballast 13 from the superstructure 10 is increased. This is easily recognizable when viewing FIGS. 1A and 2 next to one another.

A releasable intermediate frame (not shown) can naturally also be provided that comprises the second mating connection elements 6 and that is releasably couplable to the curved ballast frame 1, in particular to its first mating connection elements. In this case, one separate part more, namely said intermediate frame, would have to be handled. The above-described curved ballast frame 1 can be mentally considered as resolved into two separate parts. If the position of the winch 3 in the different positions of the ballast mounting apparatus 100 does not change or does not substantially change with respect to the superstructure 10, two or more of the connection elements can also be provided at the cured ballast frame 1 or at the ballast mounting apparatus for installing the winch 3 or the winch connection element 30. The winch connection element 30 can comprise bearings for supporting the winch 3 and, alternatively or additionally, connector parts for coupling a winch drive provided in the region of the winch with an energy supply and/or winch control at the mobile crane side.

As can furthermore be seen from FIG. 1A, the second mating connection elements 6 could be further remote from the axis of rotation of the superstructure 10 than the ballast base plate 7 or the ballast plates 5 with a small ballast radius of the mobile crane. In this case, at least one pivot bearing 8 could be provided that serves the pivoting of the second mating connection elements 6 or of the corresponding bearing structures about a vertical axis. It is thus possible to pivot the second mating connection elements 6 fully over the ballast base plate 7 or over the ballast plates 5, whereby they then no longer determine the outermost radius of rotation of the superstructure 10. It is equally possible to couple the bearing structures of all the mating connection elements 4, 6 correspondingly with the remaining structure of the ballast frame 1 via pivot bearings 8.

FIGS. 3A-3D show the connection or installation of the curved ballast frame 1 to the ballasting cylinders 1 and then to the superstructure 10. The ballast base plate 7 is positioned in the mounting apparatus provided for the respective ballast radius on the undercarriage 20. Further ballast plates 5 are optionally already placed on.

The curved ballast frame 1 is attached to a crane. This takes place in self-assembly as a rule, but could also be carried out by an auxiliary crane. The winch 3 could also already be attached to the curved ballast frame 1.

Figure 3A:
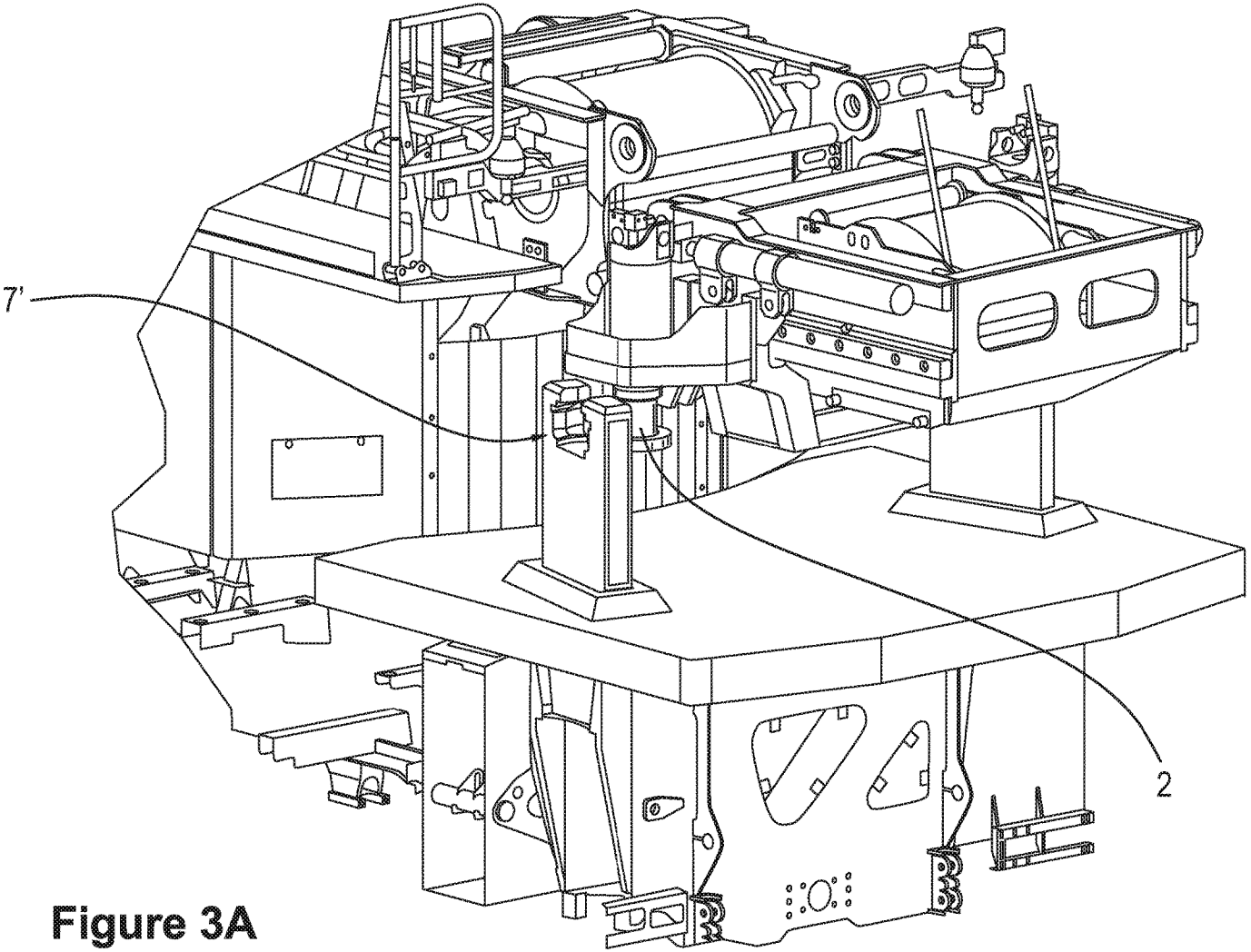
FIGS. 3A-3D show a representation of the coupling of the ballast mount to the superstructure of a mobile crane.
Figure 3B:
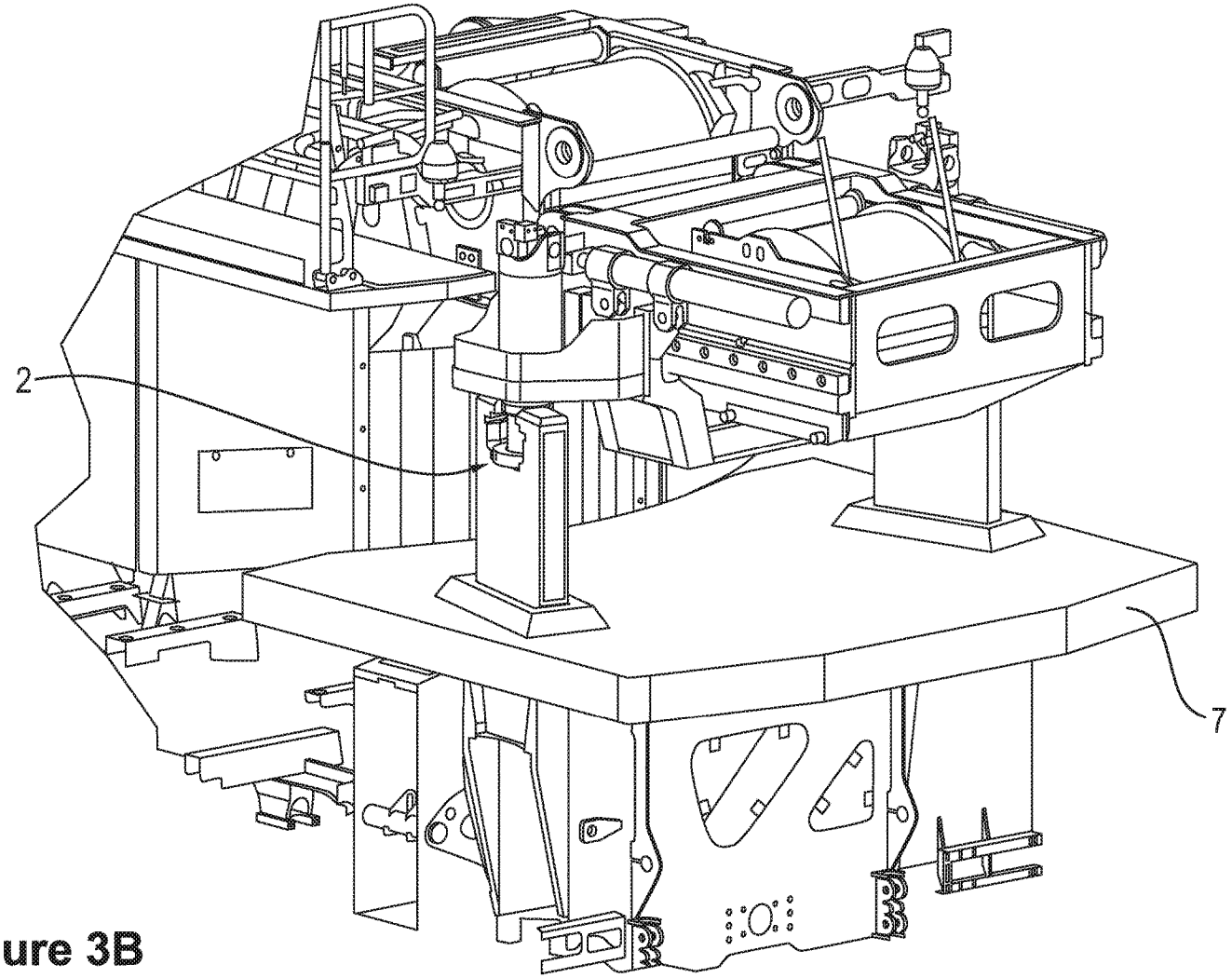

The ballasting cylinders 2 are brought to the ballast base plate 7 while in engagement with the connection element 7' (FIG. 3B).

Figure 3C:
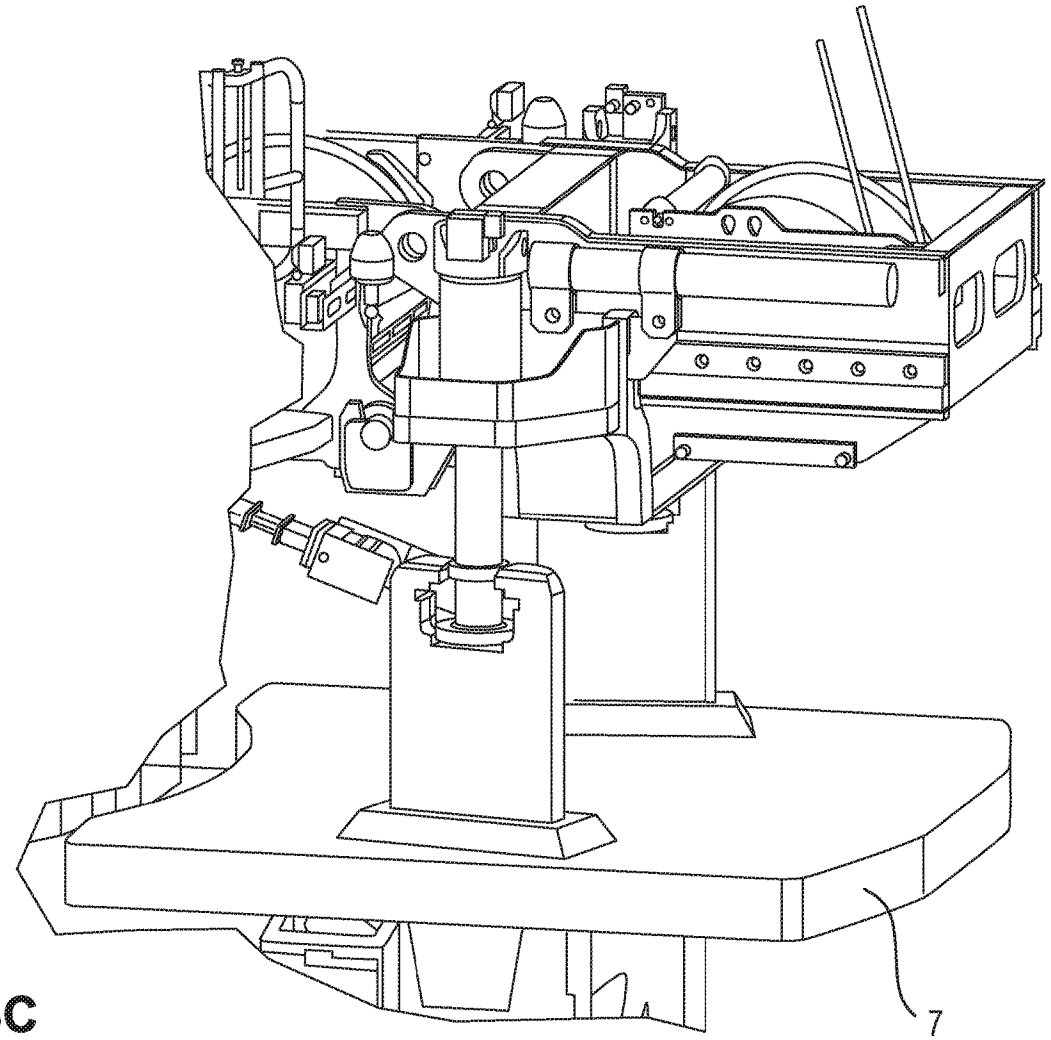
Figure 3D:
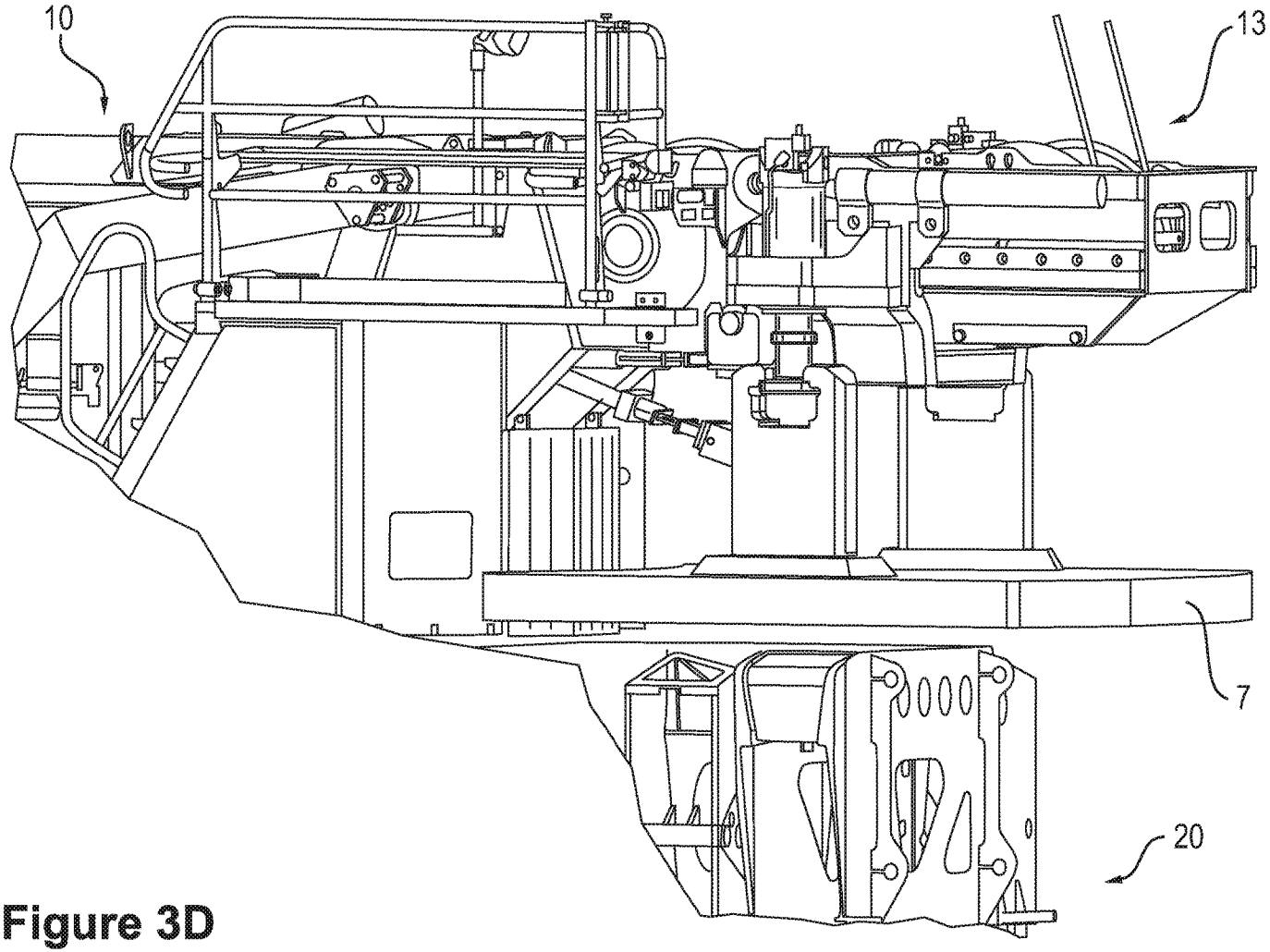

The hydraulic connection is established between the superstructure 10 and the ballasting cylinders 2. This can take place indirectly. The ballasting cylinders 2 are then extended; in so doing, they are supported on the ballast base plate 7 and raise the curved ballast frame 1 until the connection elements 11 are connectable to the corresponding mating connection elements 4 or 6 (FIG. 3C). The connection is subsequently established between the connection elements 11 and the mating connection elements 4 or 6.

The ballasting cylinders 2 are retracted again after the establishing of the connection. In this process, the ballast base plate 7 rises from the undercarriage 20 and can introduce its weight or the corresponding torque into the superstructure 10.

If a ballast rearrangement is to take place on the construction site, the curved ballast frame 1 is as a rule already attached to the superstructure 10 and the respective steps are to be adapted accordingly. It must be mentioned for reasons of comprehension that FIGS. 3A-D show a different system for increasing the ballast radius than that having the curved ballast frame 1 in accordance with an embodiment. A displacement cylinder is used here. The assembly method nevertheless remains the same.

Figure 2:
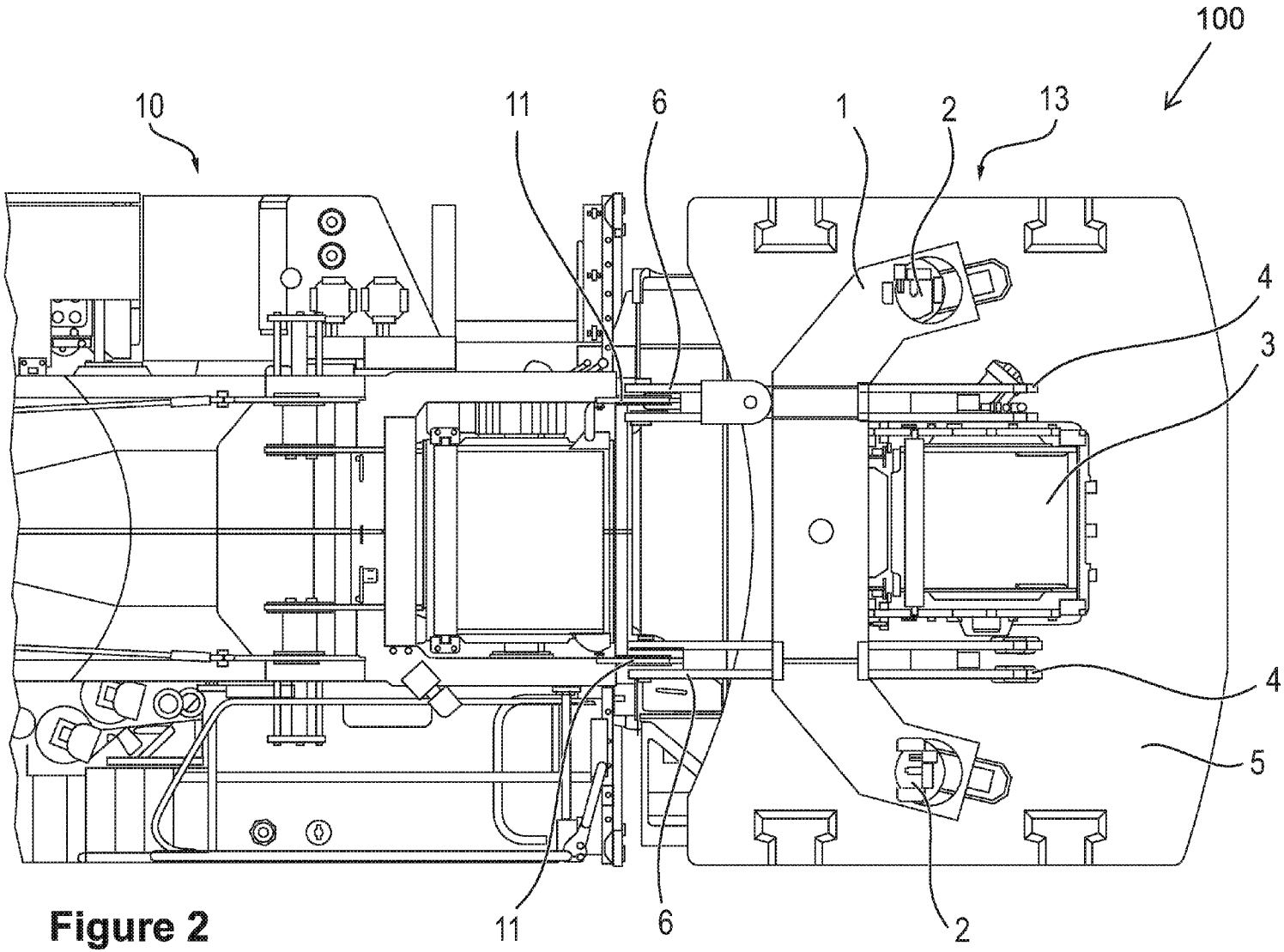
FIG. 2 shows a plan view of a mobile crane in accordance with the present disclosure with a ballast mounting apparatus in a second position.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE NUMERALS

Ballast frame 1
Ballasting cylinder 2
Winch 3
Mating connection elements 4
Ballast plates 5
Second mating connection elements 6
Ballast base plate 7
Connection element 7'
Pivot bearing 8
Superstructure 10
Connection elements 11
Ballast 13
Undercarriage 20
Winch connection element 30
Ballast mounting apparatus 100

The invention claimed is:

1. A mobile crane comprising:

an undercarriage;

a superstructure, wherein the superstructure is rotatable about an axis of rotation with respect to the undercarriage;

a ballast mounting apparatus that is couplable to the superstructure;

wherein at least one connection element is provided at the superstructure and at least two mating connection elements are provided at the ballast mounting apparatus;

wherein the ballast mounting apparatus is couplable to the superstructure by the at least two mating connection elements in positions of different distance from the axis of rotation of the superstructure;

wherein the ballast mounting apparatus comprises a ballast frame that is curved in a horizontal plane of the ballast frame and/or is U-shaped; and wherein the ballast mounting apparatus is couplable to the superstructure in two positions mutually rotated about a vertical axis.

2. The mobile crane in accordance with claim 1, wherein the at least two mating connection elements are not simultaneously couplable to the at least one connection element.

3. The mobile crane in accordance with claim 1, wherein the ballast mounting apparatus is couplable to the superstructure in two positions mutually rotated about the vertical axis by 180°.

4. The mobile crane in accordance with claim 1, wherein the at least two mating connection elements are provided at mutually oppositely disposed sides of the ballast mounting apparatus.

5. The mobile crane in accordance with claim 1, wherein the at least two mating connection elements extend by different distances from the center of mass of the ballast mounting apparatus.

6. The mobile crane in accordance with claim 1, wherein at least one winch connection element is provided at the ballast mounting apparatus for coupling a winch to the ballast mounting apparatus, with the winch connection element configured as a part of the mating connection elements.

7. The mobile crane in accordance with claim 1, wherein at least one ballasting cylinder is provided at the ballast mounting apparatus for moving the ballast mounting apparatus relative to the superstructure and/or to a base plate.

* * * * *